US007476075B2

(12) United States Patent
Geldenhuys

(10) Patent No.: US 7,476,075 B2
(45) Date of Patent: Jan. 13, 2009

(54) ROTARY PUMP

(75) Inventor: Siegfried Geldenhuys, Gauteng Province (ZA)

(73) Assignee: Weir Minerals Africa (Proprietary) Limited, Pretoria (ZA)

( * ) Notice: Subject to any disclaimer, the term of this patent is extended or adjusted under 35 U.S.C. 154(b) by 528 days.

(21) Appl. No.: 11/055,562

(22) Filed: Feb. 10, 2005

(65) Prior Publication Data

US 2005/0191175 A1 Sep. 1, 2005

(30) Foreign Application Priority Data

Feb. 12, 2004 (ZA) ..... 2004/1148
Feb. 12, 2004 (ZA) ..... 2004/1149
Feb. 12, 2004 (ZA) ..... 2004/1150
Feb. 12, 2004 (ZA) ..... 2004/1151

(51) Int. Cl.
*F04D 27/02* (2006.01)

(52) U.S. Cl. ..... 415/1; 415/126; 415/206; 415/214.1; 277/634

(58) Field of Classification Search ..... 415/88, 415/126, 127, 128, 205, 206, 214.1; 277/634, 277/644, 647, 652; 428/615, 617
See application file for complete search history.

(56) References Cited

U.S. PATENT DOCUMENTS 3,820,799 A * 6/1974 Abbes et al. ..... 277/647
4,218,067 A * 8/1980 Halling ..... 277/605
5,941,536 A 8/1999 Hill
6,237,921 B1 * 5/2001 Liotta et al. ..... 277/630
6,631,910 B2 * 10/2003 Caplain et al. ..... 277/644
6,648,333 B2 * 11/2003 Aksit et al. ..... 277/316

FOREIGN PATENT DOCUMENTS

DE 35 13 116 10/1986
EP 0 292 113 11/1988
FR 2 290 133 5/1976

* cited by examiner

*Primary Examiner*—Edward Look
*Assistant Examiner*—Aaron R Eastman
(74) *Attorney, Agent, or Firm*—Ladas & Parry LLP

(57) ABSTRACT

A rotary pump 10, e.g. a centrifugal slurry pump, has a main casing 12 housing an impeller 18 rotatable in an impeller cavity 16 defined between end liners 25, 28 and a peripheral main casing portion 24. The end liner 28, at a suction end of the impeller, is slidingly sealed via an annular seal 32 against the main casing portion 24. A radially inner, axially outwardly extending tubular portion 36 integral with the end liner 28 is aligned with a stationary tubular inlet portion 40. Seats 38, 44 respectively on the tubular portions 36, 40 oppose each other over a bridge cavity accommodating an annular bridge 50 which is expansible to allow the end liner 28 to be adjusted axially to close any gap with the impeller 18 caused by wear. Two variations of the annular bridge 50 are disclosed.

38 Claims, 5 Drawing Sheets

ROTARY PUMP

This invention relates to a rotary pump, especially a centrifugal pump, to an annular bridge for bridging an annular gap between two adjacent annular components of a rotary pump.

The Applicant expects the invention to find application primarily in pumps for pumping highly abrasive fluids, especially slurry. That application will particularly be borne in mind for purposes of this specification.

In accordance with a first aspect of this invention, there is provided a method of adjusting a configuration of a rotary pump, including axially adjusting an end portion of a casing at a suction end of the pump relative to a remainder of the casing and relative to an inlet flange of the pump, the method including displacing the end portion of the casing relative to the remainder of the casing along a peripheral seal interface, and relative to the inlet flange at a break in an inlet conduit intermediate said inlet flange and an impeller cavity, the break being bridged by an axially adjustable annular bridging ring.

In accordance with a second aspect of this invention, there is provided, in a rotary pump, at an inlet or suction end of a casing, a method of adjusting a running clearance between the casing and an impeller, including displacing a floating ring portion of the casing relative to the impeller and correspondingly to the rest of the casing and to piping conducting working fluid to the pump, the floating ring sliding at a radially outer periphery thereof relative to the rest of the casing, and moving at a radially inner periphery thereof relative to said piping, the method including bridging a varying gap between the piping and the radially inner periphery of the ring by means of an axially expansible and contractable bridge.

The invention thus provides for holding the main casing portion, and the inlet portion with piping connected thereto, stationary, while rendering said end portion floating to allow adjustment thereof to set it relative to a side of the impeller and to allow progressive axial adjustment thereof to compensate for wear or to take up wear along a corresponding end of the impeller.

In accordance with a third aspect of this invention, there is provided a casing for a rotary pump, which pump casing is in the form of an assembly including

- a peripheral main casing portion defining an exit volute for fluid being pumped;
- a tubular inlet having an inlet flange for connection to inlet piping for the pump, and a tubular section extending from the flange toward an impeller cavity defined by the pump casing, the tubular section terminating shy of said impeller cavity;
- an annular adjustable component including a ring complemental to the main casing portion for defining the impeller cavity, and an inlet port aligned with and complemental to the tubular section and leading to the impeller cavity;
- complemental annular seats on respectively the main casing portion and the adjustable component for seating therebetween a seal to form an axially adjustable interface between the main casing portion and the adjustable component;
- opposing annular seats on respectively the adjustable component and the inlet for receiving an expandable annular bridge for allowing axial adjustment between the adjustable component and the inlet; and
- an adjustment mechanism for selectively, adjustably, displacing the adjustable portion relative to the main casing portion and the inlet.

Conveniently, the adjustable component may have at its inner periphery a tubular stub providing the inlet port and being aligned with and complemental to said tubular section, said tubular section being an upstream tubular section, and said tubular stub being a downstream tubular section.

Advantageously, the adjustable component may be integral. It may be in the form of a casting, e.g. a steal casting when the casing is for a slurry pump.

Advantageously, the annular bridge may be in the form of a seal for providing sealing between the tubular inlet and the annular adjustable component. Instead, if desired, the casing may include a seal arranged functionally in parallel with the annular bridge, for sealing between the tubular inlet and the annular adjustable component.

In accordance with a fourth aspect, the invention extends to a rotary pump including a casing in accordance with the third aspect and an impeller rotatable within the casing.

The rotary pump may be in the form of a centrifugal pump. It may be in the form of a slurry pump.

More specifically in accordance with a fifth aspect, there is provided for a casing of a rotary pump, or for a rotary pump in accordance with this invention, an annular bridge including opposed annular seat formations seated on the respective annular seats, and an elastic spacer biasing the respective seat formations away from each other and being elastically collapsible and dilatable to allow the variable gap between the seat formations to be closed.

The elastic spacer may include a plurality of peripherally spatially arranged elastic links. The links may be fast with and span between the respective seat formations. Preferably, the links may be configured and arranged elastically to hinge to cause collapse and to unhinge to cause dilation. Hinging and unhinging may be generally tangentially about generally radial axes. Hinging and unhinging may be effected by relative rotation between the seat formations.

By way of development, advantageously, the bridge may include a flexible seal formation extending between the seat formations to cause the bridge to perform a seal function.

Advantageously, the bridge may be in the form of a moulding of synthetic polymeric material. The synthetic polymeric material may be selected from rubber and urethane, which has deformation/stress characteristics within the following range:

- for an elongation of 100%, the stress is between 1.8 and 3.4 $N/mm^2$, preferably 2.6 $N/mm^2$;
- for an elongation of 200%, the stress is between 4.8 and 8.7 $N/mm^2$, preferably 6.7 $N/mm^2$;
- for an elongation of 300%, the stress is between 9.6 and 16.1 $N/mm^2$, preferably 12.8 $N/mm^2$;
- for an elongation of 400%, the stress is between 16.2 and 25.6 $N/mm^2$, preferably 20.9 $N/mm^2$;
- for an elongation of 450%, the stress is between 20.2 and 31.1 $N/mm^2$, preferably 25.6 $N/mm^2$.

More specifically, in accordance with a sixth aspect, there is provided for a casing of a rotary pump, or for a rotary pump in accordance with this invention, a second species of an annular bridge including opposed annular upstream and downstream seat formations seated on the respective annular seats, and an annular body having the upstream and downstream seat formations and comprising a plurality of elastic rings, each having a rounded channel-shaped cross-section which is shaped and dimensioned annularly to nest into one-another, the rings being interconnected such as to be relatively fixed along radially inner extremities, and to be rollable over one-another along radially outer portions.

The rings may be of urethane, having surfaces conducive to sliding over one-another with little friction. Advantageously, the rings may be in the form of separate mouldings fixedly interconnected along the inner peripheries only. Said interconnected inner peripheries may then provide said upstream seat formation, which may be in the form of a flange to allow location in a complemental seat of the inlet, the downstream seat formation seating merely abuttingly on the downstream seat.

The invention is now described by way of examples with reference to the accompanying diagrammatic drawings. In the drawings FIG. 1 shows, fragmentarily, in axial section, a slurry pump in accordance with the invention and including an annular bridge in accordance with the invention;

Figure 1:
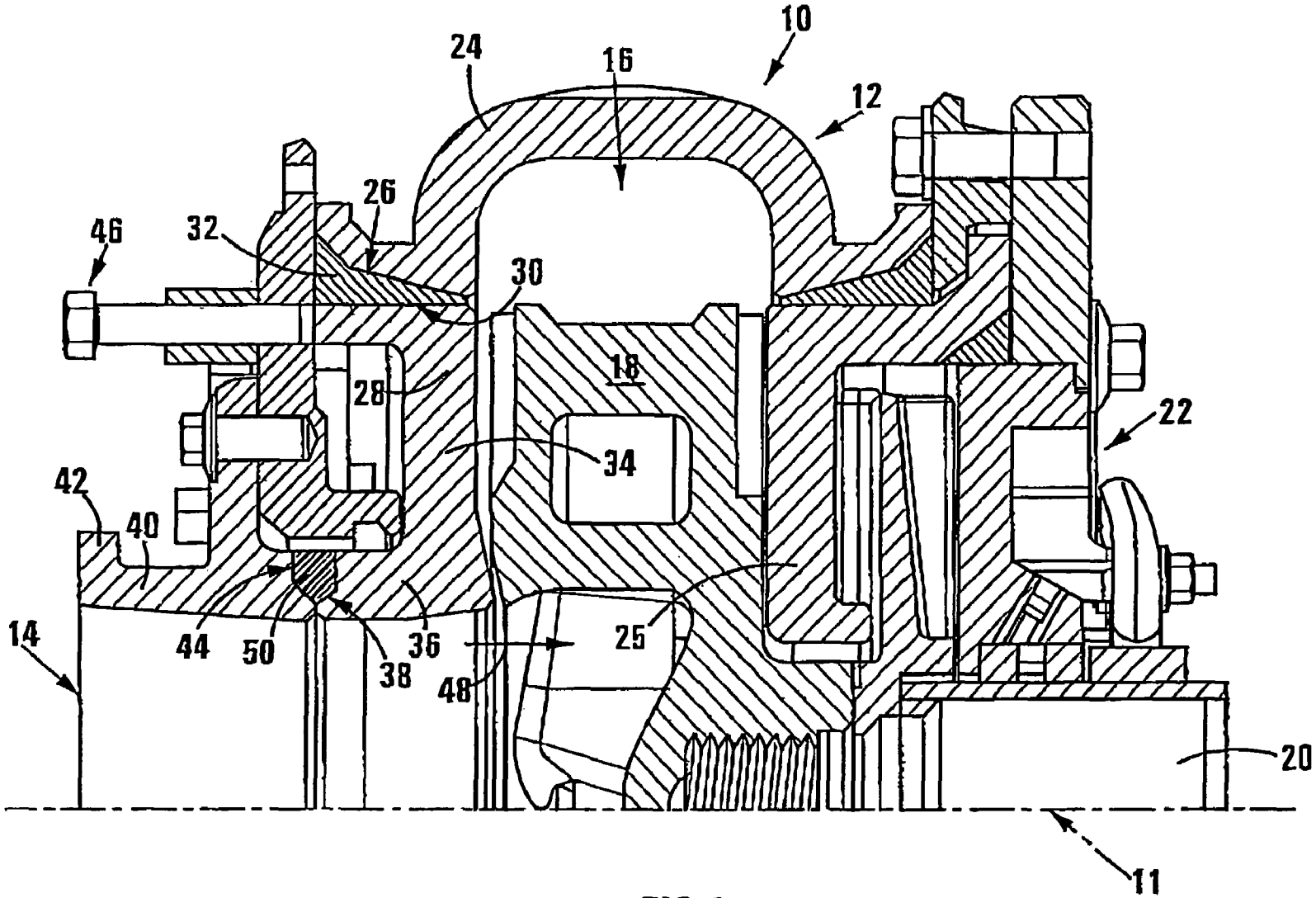
Figure 3:
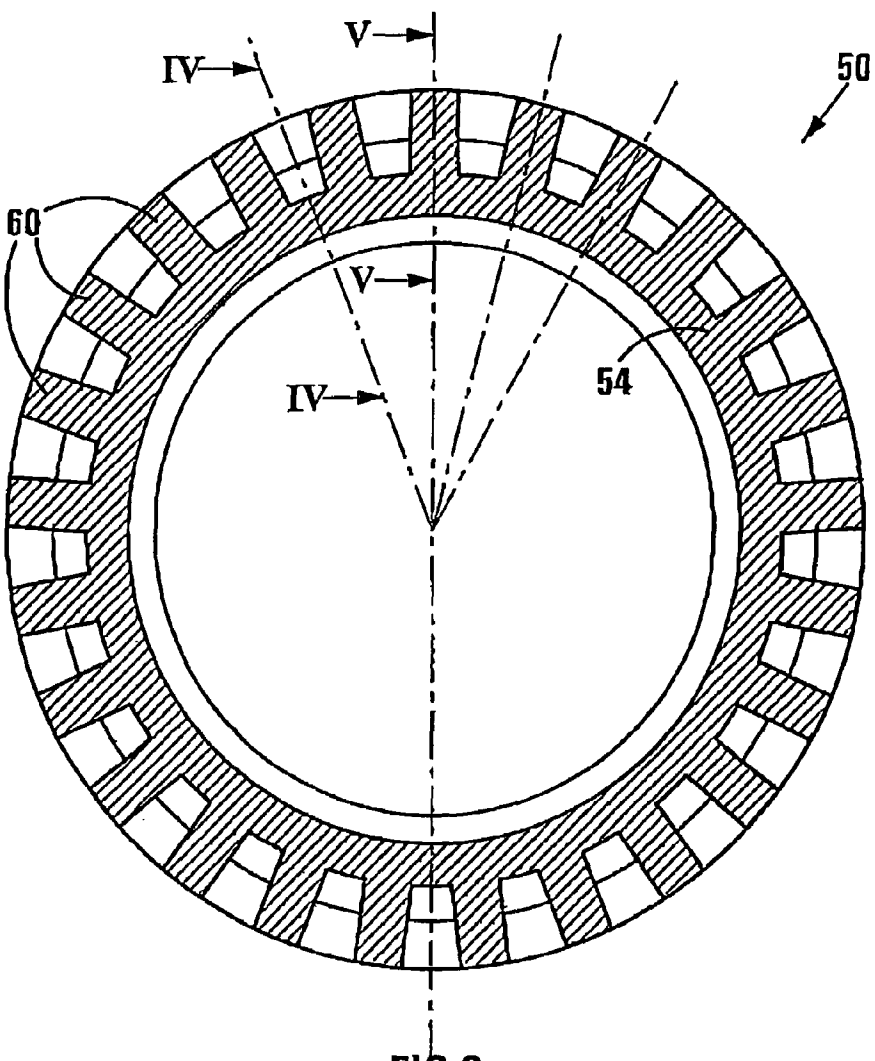
FIG. 3 shows the annular bridge of FIG. 2 in section taken at III-III in FIG. 2.
Figure 2:
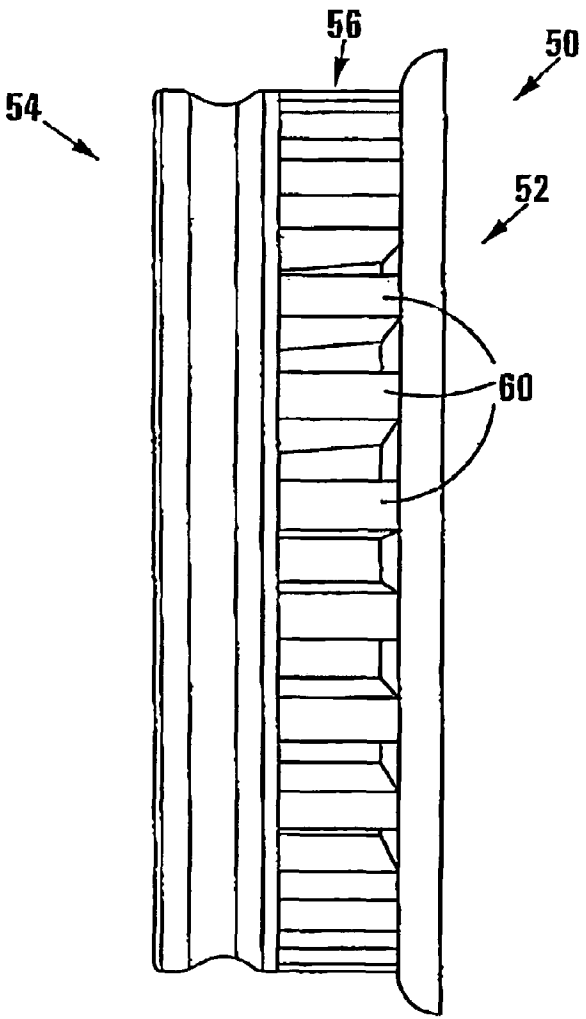
FIG. 2 shows, in side view, to a larger scale, a first embodiment of an annular bridge in accordance with the invention.

With reference to FIG. 1 of the drawings, a rotary slurry pump in accordance with this invention is generally indicated by reference numeral 10. The slurry pump 10 is generally symmetrical (except for a volute and an outlet flange thereof) to a centre line generally indicated by reference numeral 11. Only one half of the pump, to one side of the centre line 11, is shown in axial section.

The pump 10 comprises a pump casing generally indicated by reference numeral 12 and providing an inlet generally indicated by reference numeral 14, and an impeller cavity and volute generally indicated by reference numeral 16 for accommodating a rotary impeller 18. An outlet in communication with the volute is not shown in the drawing. The impeller 18 is carried on a rotary shaft 20 by means of which the impeller is rotated in use within the stationary casing 12.

Sealing is required along the end of the casing 12 corresponding to the position of the shaft 20, and which is generally referred to as the dry end or the drive end. The sealing is generally indicated by reference numeral 22. It is of composite structure and is not further described.

This invention is concerned with the construction of the pump 10, and more specifically the casing 12, at the opposed end which is generally referred to as the suction end.

The casing 12 is a composite casing comprising a main casing portion 24, and opposed end liners, respectively a drive end liner generally indicated by reference numeral 25, with which this invention is not concerned, and a suction end liner 28. The main casing portion 24 is in the form of a peripheral cap, and the drive end liner 25 and suction end liner 28 are in the form of rings.

The remainder of the specification will deal exclusively with, or mainly with, the construction at the suction end.

The main casing portion 24 and the suction end liner 28 provide opposing seats 26, 30 for a ring seal 32 having a generally tapering cross section, tapering toward a free inner end proximate the impeller cavity and volute 16. The seat 30 is concentric to allow slidable displacement in an axial direction of the suction end liner 28 relative to the main casing portion 24.

The suction end liner 28 has a ring 34 providing with the main casing portion 24 one end of the impeller cavity and volute 16. The suction end liner 28 further has a short tubular portion 36 at a radially inner extremity thereof and which opens into the centre of the impeller cavity 16. It has an upstream seat 38.

Complementally, the inlet 14 is provided by a tubular inlet portion 40 having, at a free end thereof, a flange 42 for connection to piping feeding slurry to the rotary slurry pump 10 in use, and a tubular portion having, at a downstream end thereof, a seat 44 opposing the seat 38 of the tubular portion 36. Intermediate the seats 38, 44, there is provided a bridge cavity or sealing cavity for an annular bridge 50 in accordance with the invention.

In use, the casing 12 generally, and more specifically the main casing portion 24, remains stationary. Furthermore, the tubular inlet portion 40, being connected to stationary piping, remains stationary or rigid. However, especially at the suction end of the impeller 18, it is subjected to high wear which erodes the suction end of the impeller 18 and also the corresponding face of the ring 34 and the downstream end of the tubular section 36. If such wear is not addressed, an inappropriately large gap develops between the end of the impeller 18 and the corresponding face of the ring 34, which leads to several undesired effects, mostly relating ultimately to reduced pumping efficiency. Thus, in accordance with the invention, the Applicant proposes adjusting the axial position of the suction end liner 28 continually to ensure an appropriately small gap between the end of the impeller 18 and the face of the suction end liner 28. In accordance with the invention this is achieved by having the suction end liner 28 adjustable axially as indicated by arrow 48 by means of an adjustment mechanism 46. Adjustment is made possible by allowing sliding of the suction end liner 28 via the seal ring 32 relative to the main casing portion 24, and by providing the annular bridge 50 as an expanding bridge which continually expands to fill the gap between the seats 38 and 44. In some embodiments the bridge 50 will provide sealing, and in other embodiments a separate or an auxiliary sealing mechanism is provided.

The invention thus has the advantage that wear in a particularly high wearing area can be compensated for without adjustment in the axial position of the main casing portion 24 and without adjustment in the position of the piping and the connection of the piping to the casing 12.

It further has the advantage that the suction end liner 28, which is prone to high wear, can be replaced independently of the main casing portion 24 and of the peripheral inlet portion 40.

With reference to FIGS. 2 to 5, one embodiment of an annular bridge in accordance with the invention is now described in more detail. The bridge is generally indicated by reference numeral 50, and is in the form of an integral moulding of elastic material, advantageously rubber, or urethane.

The annular bridge 50 comprises a first ring 52, an axially spaced second ring 54 defining, generally, an annular gap therebetween, indicated by reference numeral 56. At one side, the annular gap 56 is closed by means of a flexible, solid apron 58 preventing flow of fluid through the annular gap 56.

The first and second rings 52, 54 are collapsibly interconnected by a plurality of longitudinally and radially oriented links 60, which are peripherally spaced to provide gaps therebetween.

The apron 58 is flexible to a high degree, and the links 60 are elastic. In this embodiment, the annular bridge 50 is in the form of an integral or unitary moulding of rubber.

Figure 4:
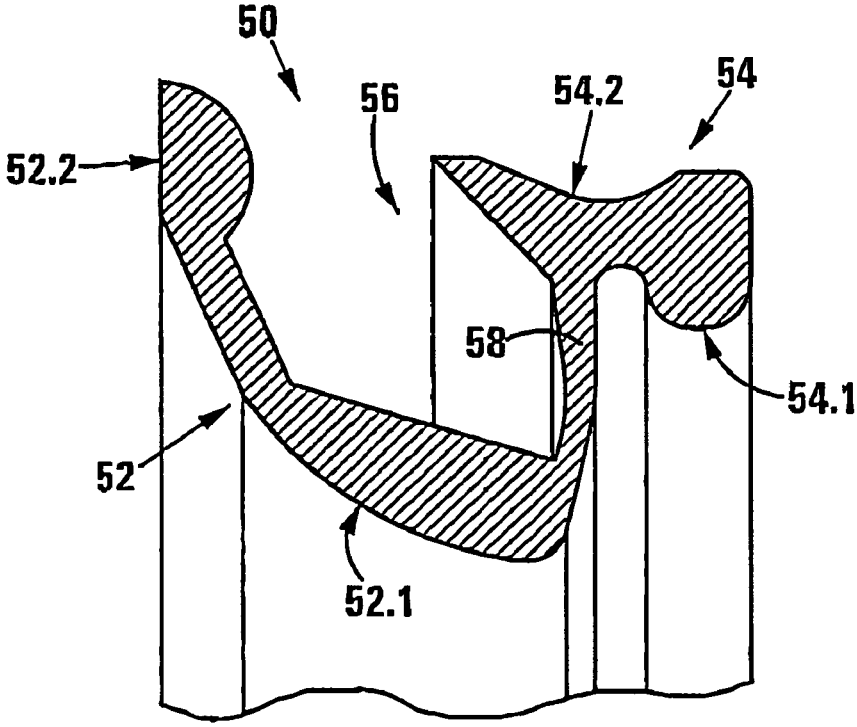
FIG. 4 shows, to a larger scale, a section taken at IV-IV in FIG. 3.
Figure 5:
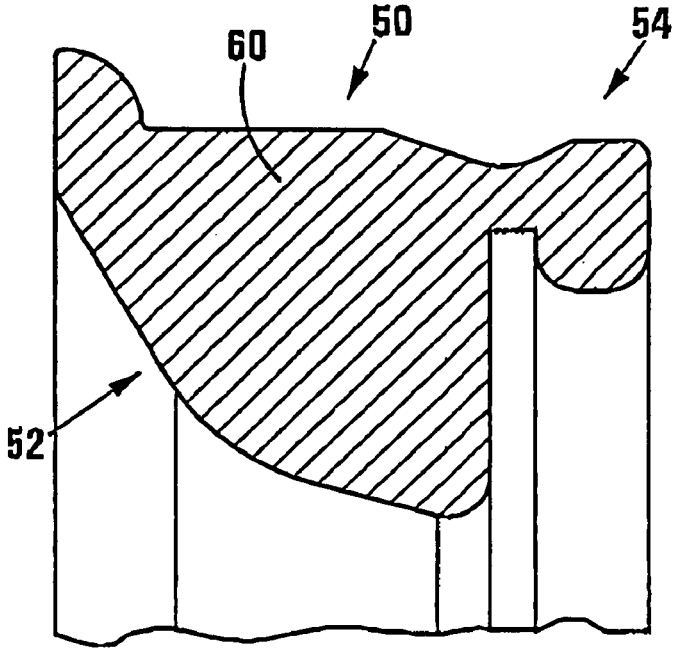
FIG. 5 shows, to a larger scale, a section taken at V-V in FIG. 3.

As can be seen from FIG. 4, the first ring 52 has an outer face 52.1 which is generally curved, and which blends into a flat annular face 52.2 at a radially outer and axially outer extremity thereof.

Along an inner periphery of the second ring 54, it has a peripheral rounded ridge in the form of a bead 54.1. Along an outer periphery of the second ring 54, it is peripherally indented to form a shallow channel 54.2.

In use, then the first ring 52 and the second ring 54 are relatively rotated about an axis of the annular ring 50, the links 60, which form hinges in accordance with the invention, are hinged effectively to collapse within the gap 56 and thus to shorten the axial length of the bridge 50. Thus, when the gap between the peripheral faces 38 and 44 shown in FIG. 1 is at a minimum, the bridge 50 is collapsed as explained above for receipt between the seats 38, 44. As the suction end liner 34 requires to be adjusted in the direction of the arrow 48, the elastic links 60 rotate progressively back from their collapsed to their erect conditions to lengthen or dilate the bridge 50 and to ensure that the gap between the seats 38 and 44 remains filled.

In this embodiment, the second ring 54 is conveniently located in position in one of the seats 38, 44 and the first ring 52 seats against the other of the seats 38, 44. Furthermore, the apron 58, which is flexible but continuous or solid, prevents flow or leakage through the annular gap 56.

Figure 6:
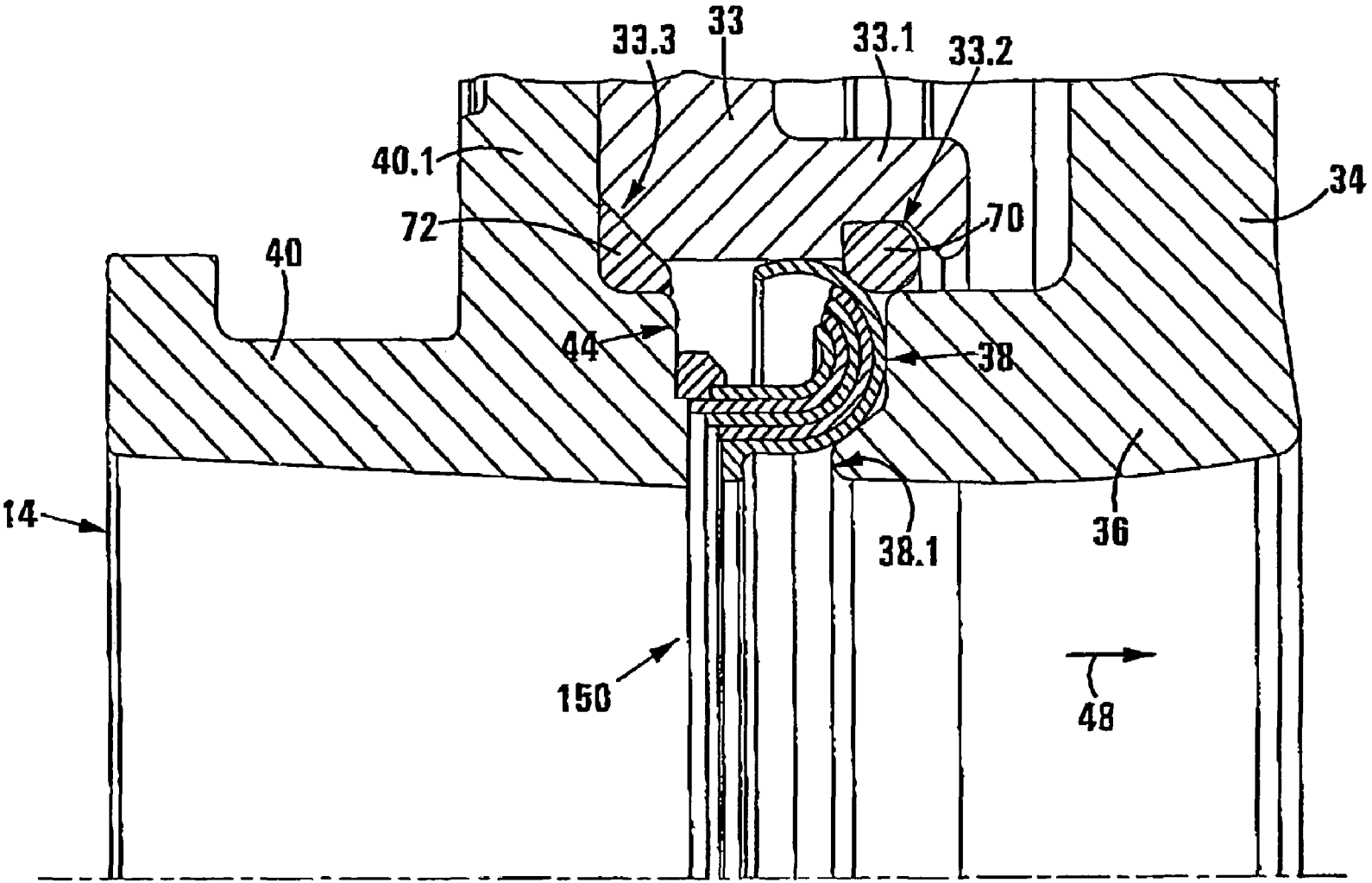
FIG. 6 shows, to a larger scale, fragmentarily, a second embodiment of an annular bridge in accordance with the invention.
Figure 7:
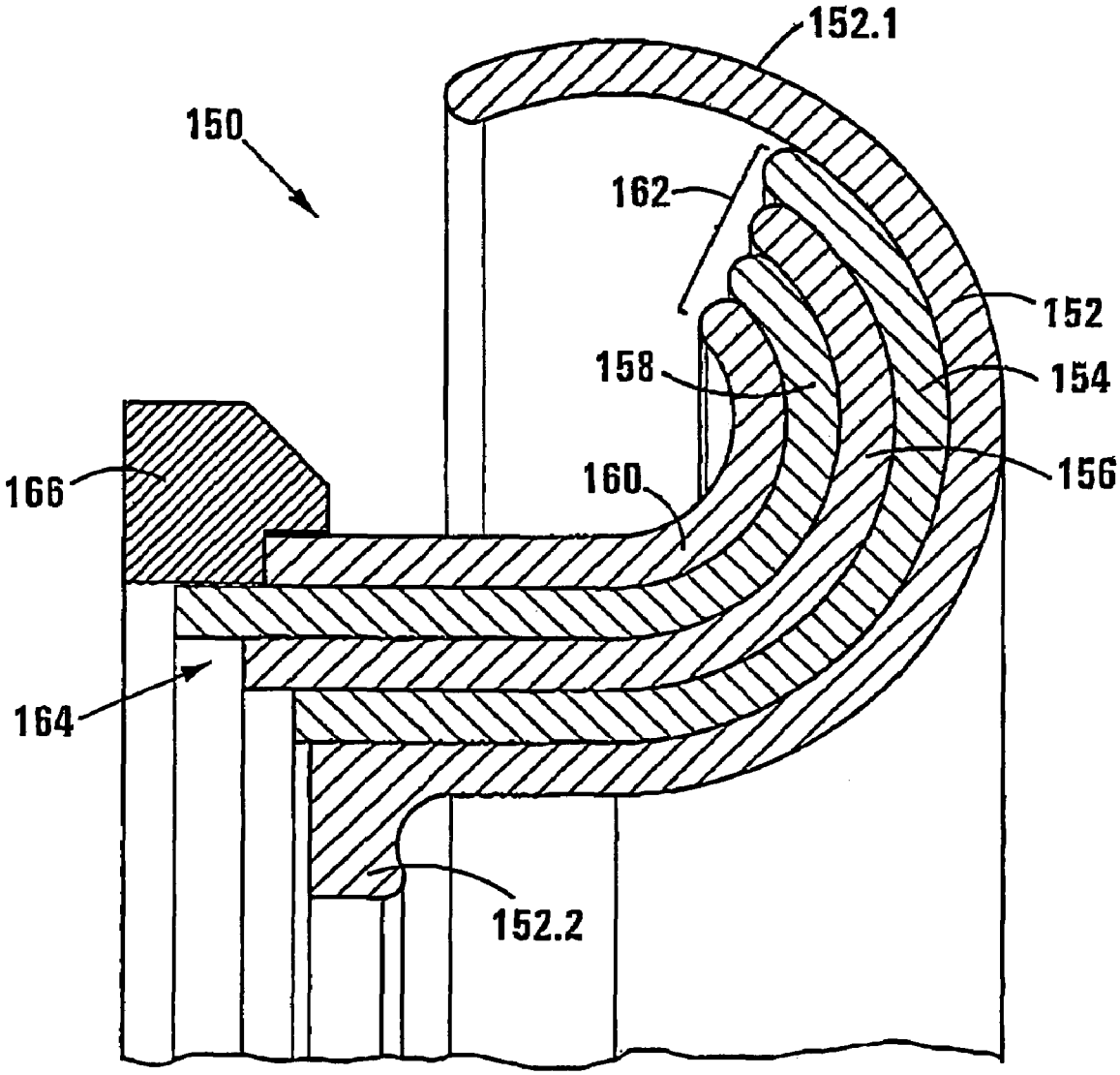
FIG. 7 shows, to an even larger scale, fragmentarily in cross-section, the annular bridge of FIG. 6.

With reference to FIGS. 6 and 7, a second embodiment of an annular bridge in the form of a seal 150 is now described.

The seal 150 comprises a plurality of rings having curved cross-sections as shown at 152, 154, 156, 158 and 160. The rings 152 to 160 are in the form of mouldings of urenthane having surfaces with low friction characteristics to be conducive to ease of sliding across one-another. The rings have curved bodies with tangential extensions extending axially along their inner peripheries. The rings 154, 156, 158 and 160 have radially outer free ends terminating adjacent one-another. The ring 152 has a projecting or extended free end portion 152.1 projecting well beyond the extremities of the other rings.

The ring 152 further has, at its radially inner end, a radially inwardly projecting flange 152.2.

The rings 154 to 158 have progressively longer axial extensions along their inner peripheries to form a stepped configuration, whereas the innermost ring 160 has a slightly truncated axial extension to accommodate a rebated seating ring 166. All of the rings are fixed at their radially inner ends, for example by an appropriate glue, welding, or the like.

With reference more particularly to FIG. 7, the seal 150 is shown received within the sealing cavity between the seats 38, 44. The seal 150 is located in the seat 44 via the seating ring 166 which seats snugly in a stepped or rebated portion of the seat 44.

The seat 38 has, at its inner periphery, a projecting annular nose 38.1, the seal 150 being received radially outwardly of the nose 38.1 and merely abuts a flat portion of the seat 38 radially outwardly of the nose 38.1.

An annular liner clamping ring 33, by means of an axially projecting flange 33.1 at an inner periphery, closes the sealing cavity defined between the seats 38, 44. The free projecting portion 152.1 of the outermost ring 152 abuts an inner periphery of the liner clamping ring flange 33.1.

In the radially inner periphery of the liner clamping ring flange 33.1, it has an annular seal cavity which is open along its radially inner extremity for receiving an O-ring seal 70, against which the ring 152 of the seal 150 abuts.

Axially spaced from the seal cavity 33.2, a corner of the liner clamping ring 33, at its upstream and radially inner extremity, is chamfered or bevelled as shown at 33.3 to provide a sealing cavity for a sealing ring 72.

As mentioned above, the seal 150 is located in the seat 44. Initially, the seat 38 is relatively close to the seat 44 thus requiring the rings 152 to 160 to roll over one-another to shorten the axial length of the seal 150 to match the small annular gap between the seats 38 and 44.

As wear of the impeller and the suction end liner progresses, the suction end liner 34 is progressively axially displaced to close the gap caused by wear thus opening up the gap between the seats 38 and 44. The rings 152 to 160, being resilient, roll open to continue to fill the gap and thus to bridge the gap to prevent inflow of working fluid into the seal cavity.

Sealing is effected by means of the seals 70, 72.

The invention has the advantage that an axially expandable annular bridge is provided to bridge an annular gap between axially adjustable annular components.

The invention claimed is:

1. A method of adjusting a configuration of a rotary pump, including axially adjusting an end portion of a casing at a suction end of the pump relative to a remainder of the casing and relative to an inlet flange of the pump, the method including displacing the end portion of the casing relative to the remainder of the casing along a peripheral seal interface, and relative to the inlet flange at a break in an inlet conduit intermediate said inlet flange and an impeller cavity, the break being bridged by an axially adjustable annular bridge including opposed annular seat formations seated on respective opposing annular seats, and an elastic spacer which includes a plurality of peripherally spatially arranged elastic links biasing the respective seat formations away from each other and being elastically collapsible and dilatable to allow a variable gap between the seat formations to be closed.

2. An annular bridge as claimed in claim 1 in which the links are fast with and span between the respective seat formations.

3. An annular bridge as claimed in claim 2 in which the links are configured and arranged elastically to hinge to cause collapse and to unhinge to cause dilation.

4. An annular bridge as claimed in claim 3 in which hinging and unhinging are generally tangentially about generally radial axes.

5. An annular bridge as claimed in claim 4 in which hinging and unhinging are effected by relative rotation between the seat formations.

6. An annular bridge as claimed in claim 1 in which the annular bridge includes a flexible seal formation extending between the seat formations to cause the bridige to perform a seal function.

7. An annular bridge as claimed in claim 1 in which the bridge is in the form of a moulding of synthetic polymeric material.

8. An annular bridge as claimed in claim 7 in which the synthetic polymeric material is selected from rubber and urethane, which has deformation/stress characteristics within the following range:

for an elongation of 100%, the stress is between 1,8 and 3,4 $N/mm^2$;

for an elongation of 200%, the stress is between 4,8 and 8,7 $N/mm^2$;

for an elongation of 300%, the stress is between 9,6 and 16,1 $N/mm^2$;

for an elongation of 400%, the stress is between 16,2 and 25,6 $N/mm^2$;

for an elongation of 450%, the stress is between 20,2 and 31,1 $N/mm^2$.

9. In a rotary pump, at an inlet or suction end of a casing, a method of adjusting a running clearance between the casing and an impeller, including displacing a floating ring portion of the casing relative to the impeller and correspondingly to the rest of the casing and to piping conducting working fluid to the pump, the floating ring sliding at a radially outer periphery thereof relative to the rest of the casing, and moving at a radially inner periphery thereof relative to said piping, the method including bridging a varying gap between the piping and the radially inner periphery of the ring by means of an axially expansible and contractable bridge, the bridge including opposed annular seat formations seated on respective opposed annular seats, and an elastic spacer which includes a plurality of peripherally spatially arranged elastic links biasing the respective seat formations away from each other and being elastically collapsible and dilatable to allow the variable gap between the seat formations to be closed.

10. A casing for a rotary pump, which pump casing is in the form of an assembly including a peripheral main casing portion defining an exit volute for fluid being pumped;

a tubular inlet having an inlet flange for connection to inlet piping for the pump, and a tubular section extending from the flange toward an impeller cavity defined by the pump casing, the tubular section terminating shy of said impeller cavity;

an annular adjustable component including a ring complemental to the main casing portion for defining the impeller cavity, and an inlet port aligned with and complemental to the tubular section and leading to the impeller cavity;

complemental annular seats on respectively the main casing portion and the adjustable component for seating therebetween a seal to form an axially adjustable interface between the main casing portion and the adjustable component;

opposing annular seats on respectively the adjustable component and the inlet for receiving an expandable annular bridge for allowing axial adjustment between the adjustable component and the inlet; and an adjustment mechanism for selectively, adjustably, displacing the adjustable portion relative to the main casing portion and the inlet, the annular bridge including opposed annular seat formations seated on the respective opposing annular seats, and an elastic spacer which includes a plurality of peripherally spatially arranged elastic links biasing the respective seat formations away from each other and being elastically collapsible and dilatable to allow the variable gap between the seat formations to be closed.

11. A casing for a rotary pump as claimed in claim 10 in which the adjustable component has at its inner periphery a tubular stub providing the inlet port and being aligned with and complemental to said tubular section, said tubular section being an upstream tubular section, and said tubular stub being a downstream tubular section.

12. A casing for a rotary pump as claimed in claim 11 in which the adjustable component is integral.

13. A casing as claimed in claim 10, which is appropriate for a slurry pump.

14. A rotary pump including a casing as claimed in claim 10 and an impeller rotatable within the casing.

15. A rotary pump as claimed in claim 14 which is in the form of a centrifugal pump.

16. A rotary pump as claimed in claim 15 which is in the form of a slurry pump.

17. An annular bridge for a rotary pump as claimed in claim 14, the annular bridge including opposed annular seat formations seated on the respective opposing annular seats, and an elastic spacer biasing the respective seat formations away from each other and being elastically collapsible and dilatable to allow the variable gap between the seat formations to be closed.

18. An annular bridge as claimed in claim 17 in which the elastic spacer includes a plurality of peripherally spatially arranged elastic links.

19. An annular bridge as claimed in claim 18 in which the links are fast with and span between the respective seat formations.

20. An annular bridge as claimed in claim 19 in which the links are configured and arranged elastically to hinge to cause collapse and to unhinge to cause dilation.

21. An annular bridge as claimed in claim 20 in which hinging and unhinging are generally tangentially about generally radial axes.

22. An annular bridge as claimed in claim 21 in which hinging and unhinging are effected by relative rotation between the seat formations.

23. An annular bridge as claimed in claim 17 in which the annular bridge includes a flexible seal formation extending between the seat formations to cause the bridge to perform a seal function.

24. An annular bridge as claimed in claim 17 in which the bridge is in the form of a moulding of synthetic polymeric material.

25. An annular bridge as claimed in claim 24 in which the synthetic polymeric material is selected from rubber and urethane, which has deformation/stress characteristics within the following range:

for an elongation of 100%, the stress is between 1,8 and 3,4N/mm$^2$;

for an elongation of 200%, the stress is between 4,8 and 8,7 N/mm$^2$;

for an elongation of 300%, the stress is between 9,6 and 16,1 N/mm$^2$;

for an elongation of 400%, the stress is between 16,2 and 25,6 N/mm$^2$;

for an elongation of 450%, the stress is between 20,2 and 31,1 N/mm$^2$.

26. An annular bridge for a rotary pump as claimed in claim 14, the annular bridge including opposed annular upstream and downstream seat formations seated on the respective annular seats, and an annular body having the upstream and downstream seat formations and comprising a plurality of elastic rings, each having a rounded channel-shaped cross-section which is shaped and dimensioned annularly to nest into one-another, the rihgs being interconnected such as to be relatively fixed along radially inner extremities, and to be rollable over one-another along radially outer portions.

27. An annular bridge as claimed in claim 26 in which the rings are of urethane, having surfaces conducive to sliding over one-another with little friction.

28. An annular bridge as claimed in claim 26 in which the rings are in the form of separate mouldings fixedly interconnected along the inner peripheries only.

29. An annular bridge as claimed in claim 28 in which said interconnected inner peripheries provide said upstream seat formation.

30. An annular bridge as claimed in claim 26 in which the upstream seat formation is in the form of a flange to allow location in a complemental seat of the inlet, the downstream seat formation seating merely abuttingly on the downstream seat.

31. A casing for a rotary pump, which pump casing is in the form of an assembly including a peripheral main casing portion defining an exit volute for fluid being pumped;

a tubular inlet having an inlet flange for connecting to inlet piping from the pump, and a tubular section extending from the flange toward an impeller cavity defined by the pump casing, the tubular section terminating shy of said impeller cavity;

an annular adjustable component including a ring complemental to the main casing portion for defining the impeller cavity, and an inlet port aligned with and complemental to the tubular section and leading to the impeller cavity;

complemental annular seats on respectively the main casing portion and the adjustable component for seating therebetween a seal to form an axially adjustable interface between the main casing portion and the adjustable component;

opposing annular seats on respectively the adjustable component and the inlet for receiving an expandable annular bridge for allowing axial adjustment between the adjustment component and the inlet; and an adjustment mechanism for selectively, adjustably, displacing the adjustable portion relative to the main casing portion and the inlet, the annular bridge including opposed annular upstream and downstream seat formations seated on the respective annular seats and an annular body having the upstream and downstream seat formations and comprising a plurality of elastic rings, each having a rounded channel-shaped cross-section which is shaped and dimensioned annularly to nest into one-another, the rings being interconnected such as to be relatively fixed along radially inner extremities and to be rollable over one-another along radially outer portions.

32. An apparatus comprising a casing of a rotary pump as claimed in claim 31 comprising an annular bridge disposed on the opposing annular seats.

33. The apparatus as claimed in claim 32 in which the rings are of urethane, having surfaces conducive to sliding over one-another with little friction.

34. The apparatus as claimed in claim 32 in which the rings are in the form of separate mouldings fixedly interconnected along the inner peripheries only.

35. The apparatus as claimed in claim 34 in which said interconnected inner peripheries provide said upstream seat formation.

36. The apparatus as claimed in claim 32 in which the upstream seat formation is in the form of a flange to allow location in a complemental seat of the inlet, the downstream seat formation seating merely abuttingly on the downstream seat.

37. A method of adjusting a configuration of a rotary pump, including axially adjusting an end portion of a casing at a suction end of the pump relative to a remainder of the casing and relative to an inlet flange of the pump, the method including displacing the end portion of the casing relative to the remainder of the casing along a peripheral seal interface, and relative to the inlet flange at a break in an inlet conduit intermediate said inlet flange and an impeller cavity, the break being bridged by an axially adjustable annular bridge including opposed annular upstream and downstream seat formations seated on the respective annular seats and an annular body having the upstream and downstream seat formations and comprising a plurality of elastic rings, each having a rounded channel-shaped cross-section which is shaped and dimensioned annularly to nest into one-another, the rings being interconnected such as to be relatively fixed along radially inner extremities and be rollable over one-another along radially outer portions.

38. In a rotary pump, at an inlet or suction end of a casing, a method of adjusting a running clearance between the casing and an impeller, including displacing a floating ring portion of the casing relative to the impeller and correspondingly to the rest of the casing and to piping conducting working fluid to the pump, the floating ring sliding at a radially outer periphery thereof relative to the rest of the casing, and moving at a radially inner periphery thereof relative to said piping, the method including bridging a varying gap between the piping and the radially inner periphery of the ring by means of an axially expansible and contractible bridge, the bridge including opposed annular upstream and downstream seat formations seated on the respective annular seats and an annular body having the upstream and downstream seat formations and comprising a plurality of elastic rings, each having a rounded channel-shaped cross-section which is shaped and dimensioned annularly to nest into one-another, the rings being interconnected such as to be relatively fixed along radially inner extremities and to be rollable over one-another along radially outer portions.

* * * * *